US011731034B2

(12) United States Patent
Purraad et al.

(10) Patent No.: US 11,731,034 B2
(45) Date of Patent: Aug. 22, 2023

(54) THREE-DIMENSIONAL EXPANDABLE BOARD GAME

(71) Applicant: Iromino Games LLP, Richmond (CA)

(72) Inventors: Ramin Purraad, Richmond (CA); Parsa Tajbakhsh, Richmond (CA); Reza Tajbakhsh, Richmond (CA); Yasaman Tajbakhsh, Richmond (CA)

(73) Assignee: Iromino Games LLP, Richmond (CA)

( * ) Notice: Subject to any disclaimer, the term of this patent is extended or adjusted under 35 U.S.C. 154(b) by 3 days.

(21) Appl. No.: 17/171,973

(22) Filed: Feb. 9, 2021

(65) Prior Publication Data

US 2021/0245036 A1 Aug. 12, 2021

Related U.S. Application Data

(60) Provisional application No. 62/972,495, filed on Feb. 10, 2020.

(51) Int. Cl.
*A63F 3/00* (2006.01)

(52) U.S. Cl.
CPC ..... *A63F 3/00214* (2013.01); *A63F 3/00697* (2013.01); *A63F 2003/0022* (2013.01); *A63F 2003/00725* (2013.01); *A63F 2003/00813* (2013.01)

(58) Field of Classification Search
CPC ..... A63F 3/00214; A63F 3/00697; A63F 2003/0022; A63F 2003/00725; A63F 2003/00813; A63F 9/12
See application file for complete search history.

(56) References Cited

U.S. PATENT DOCUMENTS

| | | | | |
|---|---|---|---|---|
| 4,722,712 | A | 2/1988 | McKenna | |
| 4,808,140 | A | 2/1989 | Clavet | |
| 5,525,089 | A | 6/1996 | Heinz | |
| 5,941,527 | A * | 8/1999 | Selton | A63F 3/00214 273/276 |
| 2008/0161079 | A1 * | 7/2008 | Wei | A63F 13/46 463/9 |

(Continued)

FOREIGN PATENT DOCUMENTS

CA 2 605 426 A1 10/2006

OTHER PUBLICATIONS

"Tetris" wikipedia, http://web.archive.org/web/20180817091750/https://en.wikipedia.org/wiki/Tetris, pulled from publication on Aug. 17, 2018 (Year: 2018).*

(Continued)

*Primary Examiner* — Michael D Dennis
(74) *Attorney, Agent, or Firm* — Mintz, Levin, Cohn, Ferris, Glovsky and Popeo, P.C.; F. Jason Far-hadian, Esq.

(57) ABSTRACT

Building blocks that facilitate configuration and assembly of playing pieces, in shapes of stair-like or clusterable edge-connected partially or fully cube-shaped pieces, are provided. According to a particular configuration of blocks, a main sub-block in the shape of half-cubes is provided, with multi edge-connectivity formation means/possibilities. The edge connectivity possibilities of the provided half-cubes are mainly implemented for the purpose of assembling and configuring clusterable stair-like playing pieces including multi-edge- and/or face-connectable cubes.

9 Claims, 15 Drawing Sheets

(56) References Cited

U.S. PATENT DOCUMENTS

2013/0270769 A1* 10/2013 Powell ..... A63F 3/00214
273/157 R

OTHER PUBLICATIONS

Mattel Games, "Blokus." Rule Book, 2013, BJV44-0920 [online] [retrieved on May 18, 2021 (May 18, 2021)]. 4 pages. Retrieved from the Internet <https://service.mattel.com/instruction_sheets/BJV44-Eng.pdf>.

* cited by examiner

THREE-DIMENSIONAL EXPANDABLE BOARD GAME

CROSS REFERENCE TO RELATED APPLICATIONS

This application claims priority to U.S. Provisional Application No. 62/972,495, filed Feb. 10, 2020, which is hereby incorporated by reference herein in its entirety and for all purposes.

TECHNICAL FIELD

The disclosed subject matter relates generally to structuring a platform for creating strategy games, and more particularly to three-dimensional (3D) expandable board games that utilize clusterable game pieces for brain stimulation and entertainment purposes.

BACKGROUND

Strategy board games are entertaining and stimulating. Some games aim to minimize luck by promoting strategy over unpredictable and non-deterministic elements, such as dice rolls or shuffled cards. Most games are typically subject to rules that have different degrees of complexity. Some well-known strategy board games include Chess, Checkers and Go.

SUMMARY

For purposes of summarizing, certain aspects, advantages, and novel features have been described herein. It is to be understood that not all such advantages may be achieved in accordance with any one particular embodiment. Thus, the disclosed subject matter may be embodied or carried out in a manner that achieves or optimizes one advantage or group of advantages without achieving all advantages as may be suggested herein.

In accordance with one or more embodiments, a system of building blocks is provided that is configured to include sub-blocks with a main sub-block in the shape of a multi-edge connectable half-cube. The main sub-block may be made of rigid plastic material and designed for being easily joined to another adjacently arranged half-cube sub-block. The main sub-blocks may be connected to facilitate the assembly of one or more playing pieces in shapes of clusterable multi-edge connectable cubes.

The main sub-blocks may provide the playing pieces for playing a basic expandable stair-like board game based on strategic rules. The playing pieces may be formed into stair-like, or multi-level connectible cubes. The cubes may be connected by way of one or more edges or geometric faces and used for educational or entertainment purposes. In certain embodiments, the geometric game pieces may be strategically positioned by a user or player to form an expandable board game (e.g., a stair-like or multi-level collection of connected boards). Corresponding basic playing rules and related clusterable playing pieces may be utilized or configured (e.g., in the shape of stair-like edge- and/or face-connected cubes) as main playing pieces to create turn-based expandable board games.

One or more main playing pieces may be configured and assembled by a system of blocks with a type of sub-block having the capability for edge and/or face connectivity (with other adjacently arranged sub-blocks) for assembling and configuring clusterable playing pieces for playing a basic expandable board game of strategy. The expandable board game of strategy, together with two basic playing rules, presents a platform for creating various expandable board games to be played simultaneously, as secondary games, on a 3D playing area (e.g., as secondary playing board surface) formed on clustered cubes of already played playing pieces.

In accordance with certain embodiments, a game system is provided that facilitates assembly and formation of tangible stair-like playing pieces that are clusterable and may be used for playing a basic game in 3D clusters of arranged cubes. The cluster arrangements of the playing pieces may be utilized for creating/playing the board games that may be adapted to form expandable stair-like attached boards.

In one aspect, playing pieces may be in the shape of clusterable cubes that may be connected at one or more edges or surfaces. The clusterable cubes may be implemented for playing preferably turn-based, space-filling and expandable (optionally stair-like) board games. The board games may be based on two rules that define how the presented playing means are placed on boards and on each other, in order to fill the allowed square spaces, whether these square spaces belong to the board or are square faces of cubes of playing pieces already played. The strategy game played based on two basic rules is referred to as the primary game or the Basic Game.

The Basic Game may be an absolute strategy board game, played based on two basic and mandatory rules, for example, using the presented clusterable playing pieces that themselves create an expanded 3D playing board area or surface (during the play) for playing another secondary game, simultaneously with the Basic Game.

Certain game implementations may include Three-Edge-Connected Cubes, which include one cube in the middle and two connected hanging side-cubes. The Three-Edge-Connected cubes may be chosen as default playing means for playing the Basic Game, and also for explaining/illustrating the Two Basic Rules, and showing the correct play and goal of the Basic Game as depicted in FIGS. 20-28.

Primary and Basic Rules (e.g., rules number One and Two) may be fundamental and compulsory rules governing "The Basic Game" of any versions of stair-like expandable board game that utilize clusterable playing pieces in shapes of edge- and/or (stair-like) face-connected cubes.

In one example embodiments, a game piece for use in a board game is provided where the game piece comprises at least two partially or fully cube-shaped pieces connectable at a connection point of corner edges of the at least two partially or fully cube-shaped pieces, such that a first corner edge of a first partially or fully cube-shaped piece is connectable to a second corner edge of a second partially or fully cube-shaped piece. The connection point may comprise a separate, removable joint piece that can be releasably connected to the first corner edge or the second corner edge or both. The at least two partially or fully cube-shaped pieces form a single monolithic piece.

The first corner edge of the first partially or fully cube-shaped piece may be connected to the second corner edge of the second partially or fully cube-shaped piece along a virtual axis joining collinear corner edges of at least one of the first partially or fully cube-shaped piece or the second partially or fully cube-shaped piece. At least one of the at least two partially or fully cube-shaped pieces comprises a first hollow sub-block and a second hollow sub-block. The second hollow sub-block is configured as a mirror image of the first hollow sub-block. The first hollow sub-block and the second hollow sub-block may be configured to connect to each other to form one of the at least two partially or fully cube-shaped pieces.

The first hollow sub-block may include at least one male connection feature and the second hollow sub-block comprises at least one female connection feature for receiving the at least one male connection feature. The at least one male connection feature mates with the at least one female connection feature to form the at least one of the two partially or fully cube-shaped pieces. The first corner edge of the first partially or fully cube-shaped piece may be connected to the second corner edge of a second partially or fully cube-shaped piece such that at least one side wall of the first partially or fully cube-shaped piece forms an approximately 90 degree angle with at least one side wall of the second partially or fully cube-shaped piece.

In certain embodiments, a method of playing a board game is provided. The method may be based on a first basic rule, a second basic rule, and a game goal for a winning player to be selected from among a plurality of players playing the board game as a player that first moves a game piece such as that disclosed above on a game board in a last available configuration that complies with the first basic rule and the second basic rule, such that no other game piece can be placed on the game board in a configuration that complies with the first basic rule and the second basic rule.

In one implementation, the first basic rule may require that a first game piece may not be placed adjacent to a second similarly shaped game piece in a same position as the second game piece, such that each portion of the first game piece is substantially on top of each corresponding portion of the second similarly shaped game piece. The second basic rule may require that no empty game space exist between the game board and a game piece placed on the board game as a part of a move made by a player participating in the game.

A plurality of game boards may be connected in a stair-like configuration, wherein a connection between at least two of the plurality of game boards comprises a game piece having a first portion on a first game board and a second portion on a second portion of a second game board. The first basic rule and the second basic rule may be implemented such that the game is not played endlessly on the first game board, and wherein the second game board is connectable to the first game board using a game piece played on the first game board in accordance with the first basic rule and the second basic rule.

Various embodiments of the disclosed subject matter have been described herein, by way of example, as applicable to tangible physical game pieces that can be manipulated and structured as pieces that can be physically connected in a real world environment. It is noteworthy, however, that the disclosed inventive concepts and pieces may also be implemented in a computing environment in which the pieces may be handled or managed by way of one or more user interfaces (e.g., a 3D graphical user interface) in a digital operating environment.

BRIEF DESCRIPTION OF THE DRAWINGS

The disclosed embodiments may be better understood by referring to the Figures in the attached drawings, as provided below. Please note that the Figures are presentations of example embodiments

FIG. 7 is intended to show the possibility of designing several versions of edge-connected cubes and also explain and emphasize that different versions may conform to basic clusterability rules.

FIG. 8 is intended to show the possibility of designing several versions of edge-connected cubes and also explain and emphasize that different versions may conform to basic clusterability rules.

FIG. 9 is intended to show the possibility of designing several versions of edge-connected cubes and also explain and emphasize that different versions may conform to basic clusterability rules.

FIG. 18 illustrates an example version of a stair-like expandable board.

FIG. 19 illustrates another example version of a stair-like expandable board.

Features, elements, and aspects that are referenced by the same numerals in different Figures represent the same, equivalent, or similar features, elements, or aspects, in accordance with one or more embodiments.

DETAILED DESCRIPTION OF EXAMPLE EMBODIMENTS

Figure 1:
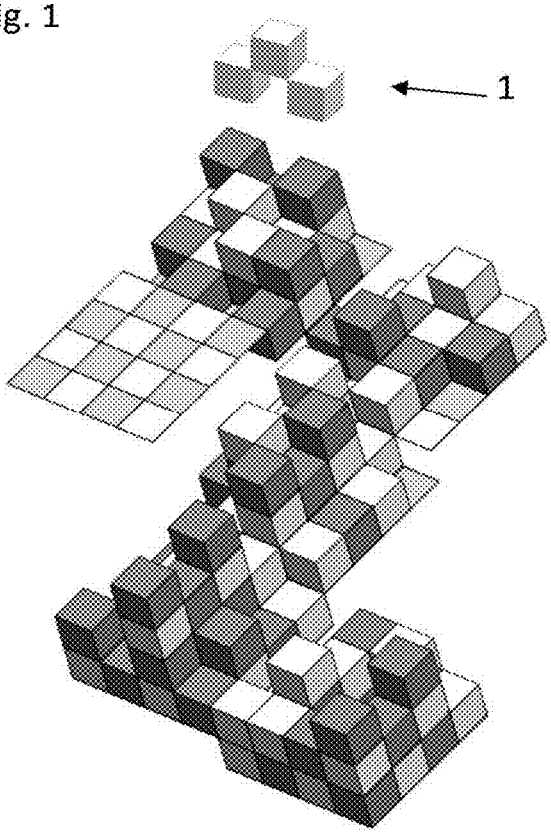
FIG. 1 shows a perspective view of expandable stair-like boards in a 3D digital game, played with playing pieces such as a Three Edge-Connected Cube 1, hereafter referred to as Trio-Cubes1.

In the following, numerous specific details are set forth to provide a thorough description of various embodiments. Certain embodiments may be practiced without these specific details or with some variations in detail. In some instances, certain features are described in less detail so as not to obscure other aspects. The level of detail associated with each of the elements or features should not be construed to qualify the novelty or importance of one feature over the others.

In accordance with one or more embodiments, systems of building blocks that facilitate configuration and assembly of playing pieces, in shapes of stair-like and clusterable edge-connected partially or fully cube-shaped pieces, are provided. According to a particular system of blocks, the main sub-block in the shape of a half-cube is provided with multiple edge-connectivity formation means/possibilities. The edge connectivity possibilities of the claimed half-cube are mainly implemented for the purpose of assembling and configuring clusterable stair-like playing means of multi-edge- and/or face-connected partially or fully cube-shaped pieces.

The default playing means may be configured of three partially or fully cube-shaped pieces forming a V-shape (or A-shape) of three edge-connected partially or fully cube-shaped pieces, one in the middle and two side partially or fully cube-shaped pieces, for playing preferably the basic version of a turn-based, space-filling and expandable strategy board game. The board game is to be played based on two primary and Basic Rules that define how the playing means are placed on boards and on each other, in order to fill the allowed square spaces, and whether these square spaces belong to the board or are square-faces of partially or fully cube-shaped pieces (of playing pieces) already played (or placed).

The First Basic Rule is: "One on One Not Allowed" which means that placing a plying piece exactly on the same playing piece (with the same number of cubes), and with the same position, cube by cube, is Not Allowed. The Second Basic Rule is: "No empty space allowed under any cube", which means that each cube of the playing piece is to be placed either on a board square face, or on a square face of another cube (of an already played playing piece, if it is allowed based on rule number one).

Basic Rules One and Two are primary, constitutive and mandatory rules for playing the Basic Game version of expandable board games using clusterable and stair-like edge-connected cubes as their main playing pieces. The Basic Game (of expandable board games, consisting of main playing pieces and the playing method based on two basic rules), provides a platform for creating new games or remaking and adapting various types of board games for being played as secondary games simultaneously with the Basic Game on a 3D board playing area that is formed, and continuously expanded and developed, on square faces of clustered cubes (of main playing pieces of Basic Game). The expanding 3D board surfaces generate variable and shifting playing situations that are essential for brain stimulation and entertainment purposes.

In accordance with one embodiment, the game system may comprise the following elements: clusterable playing means (or playing pieces) in the form of "Edge-Connected Cubes", particularly three cubes connected to each other at their edges (forming a V-shape or A-shape "Trio-Cubes" having one cube in the middle and two side cubes), as default playing pieces. The physical playing pieces of Trio-Cubes (or Multi-Cubes) may contain one or several parts (or sub-blocks), the assembly of which is to comply with the design rule of (virtual) zero-dimension of connecting-line between the cubes, such that the playing piece could be clusterable.

The board is optionally a 4 rows by 4 columns board with 16 squares, such that the dimension of each square is to be equal to the dimension of each cube's square face (of playing pieces). More boards can be connected to the played and finished board, in order to expand the game area horizontally in any desired direction at the same level of the previously played board, or one cube level up, for the purpose of forming stair-like (connected) boards.

As a secondary rule, the playing area may be optionally extended to previously played (finished) boards and played pieces (as expanded game playing area), making the game more complicated. Based on this secondary rule, placing new playing pieces on the extended board area (including the square faces of already played pieces) based on rules one and two, is allowed and it is not considered an out of the board play. The extended playing area creates new situations for players, making the game more challenging (and brain stimulating), and the chances for any predictable final winning move remain unknown until the last few moves.

Method of Play: With the Basic Game, each board's game starts with player one placing his/her playing piece on board, only based on the basic rules one and two, and ends only when one of the players places his/her playing piece on the last possible position and leaves no position (or room) for any other player to add or play any other playing piece that can also comply with the basic mandatory rules one and two.

Object of each game set: The Basic Game of the expandable board games are (by default) played board by board, therefore, in a basic game version, the goal of each set of the game (or the board under play), is achieved by placing the last playing piece on the board as the last winning move that does not allow any other playing piece to find a correct position (according to basic rules one and two) for a piece to be placed on the game playing area.

The player (or team of players) who play the last winning move, would be the winner of that played board or set. With the Basic Game version, the final winner is the player (either an individual player or team of players) that wins the most finished boards when the final board in the game is played. Further scoring and points gaining rules can be defined within secondary or tertiary rules. The final played board can be defined by the number of boards to be played, which can be any number from 1 to "n" (where "n" can be a number of boards available for playing a physical game or a predefined number in a digital game version, or even played endlessly).

Individual players or teams of players may compete against other individual players or teams of players. Also, individual players or teams of players may compete against a device (for example: a personal computer or mobile phone or any other gaming machine) using a software (i.e. program/application) developed based on the above defined objectives and rules, which is intended to function as a competitive player (or opponent).

By default, the Basic Game is played board by board, but may optionally be played on sets of stair-like (attached) boards, and played set by set (instead of board by board), and in this case, the goal of each set is achieved when the final winning move doesn't allow any other playing piece to be placed on the playing area. The playing area may include several attached boards or only one board. Accordingly, the winner of the final game is the player (or team of players) that wins the most number of played sets within a predefined period of time, for example, or the final winner could be determined by calculating a mix of points achieved by playing a secondary adopted game of any type of strategy board game to be simultaneously played on the 3D playing area generated by clustered cubes of playing pieces of a Basic Game.

Figure 2:
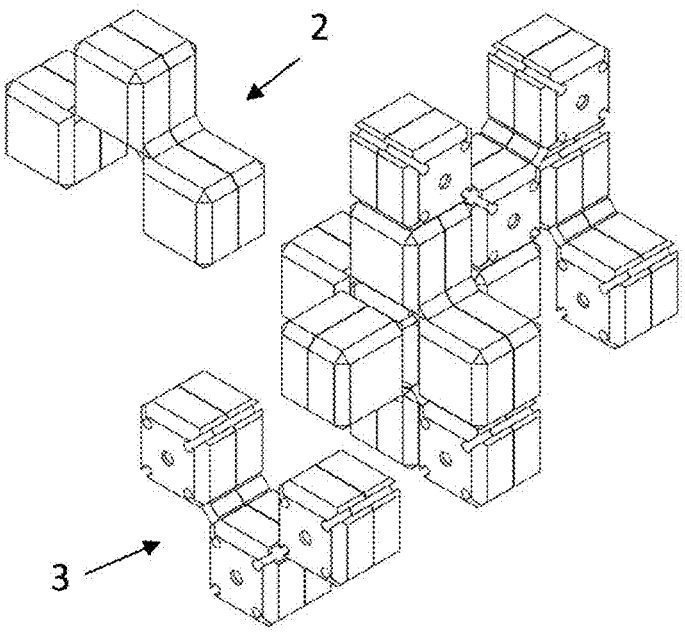
FIG. 2 shows an isometric view of a cluster of assembled Tangible Three Edge-Connected Cubes 2 and 3, hereafter referred to as Trio-Cubes2 and Trio-Cubes3.

Referring to FIG. 1, a perspective view of expandable stair-like boards in a 3D digital game is provided. The game may be played with playing pieces such as a Three Edge-Connected Cube 1, or "Trio-Cubes1." As shown in FIG. 2, a cluster of assembled Tangible Three Edge-Connected Cubes 2, or "Trio-Cubes2," and 3, or "Trio-Cubes3," may be assembled in sub-blocks designed to conform with clusterability designing rules, depicted at FIGS. 3 and 4.

Figure 3:
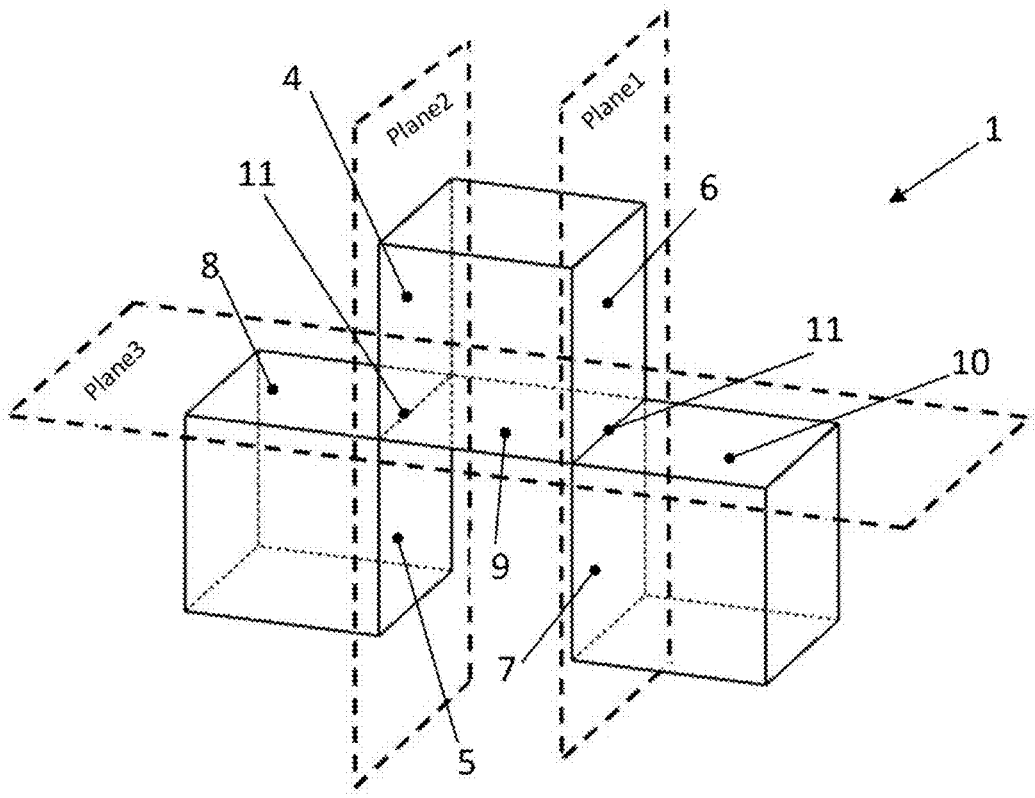
FIG. 3 illustrates a perspective view of a playing piece in shape of Three Edge-Connected Cubes 1 (or Trio-Cubes1), one cube in the middle and two side cubes.

Referring to FIG. 3, a playing piece in shape of Three Edge-Connected Cubes 1 (or Trio-Cubes1) is provided, which has one cube in the middle and two side cubes. Trio-Cubes1 may serve as the main default playing means/pieces for playing stair-like expandable board games. The middle cube shares a connecting line 11 with the side-cubes and accordingly the middle cube has a zero-thickness edge connection (line segment) with its side cubes. Obviously, the connecting line 11 (or line segment 11) between the connected cubes has a zero thickness, and each of the vertical faces of middle cube 4 and 6 are in one plane with the corresponding vertical faces on side cubes (for example, left face 4 of middle cube and right face 5 of left-side cube are on one vertical plane Plane2 and right face 6 of middle cube and left face 7 of right-side cube are on one vertical plane Plane1). Also, the horizontal bottom face 9 of middle cube is on one horizontal plane Plane3 with top faces 8 and 10 of side cubes. Accordingly, for the purpose of having clusterable edge-connected playing pieces (that are needed for playing expandable stair-like board games), physically or virtually Zero Thickness Edge Connections (line segments 11) are maintained between the edge-connected cube (for the purpose of maintaining the clusterability of face and/or edge-connected cubes).

Figure 4:
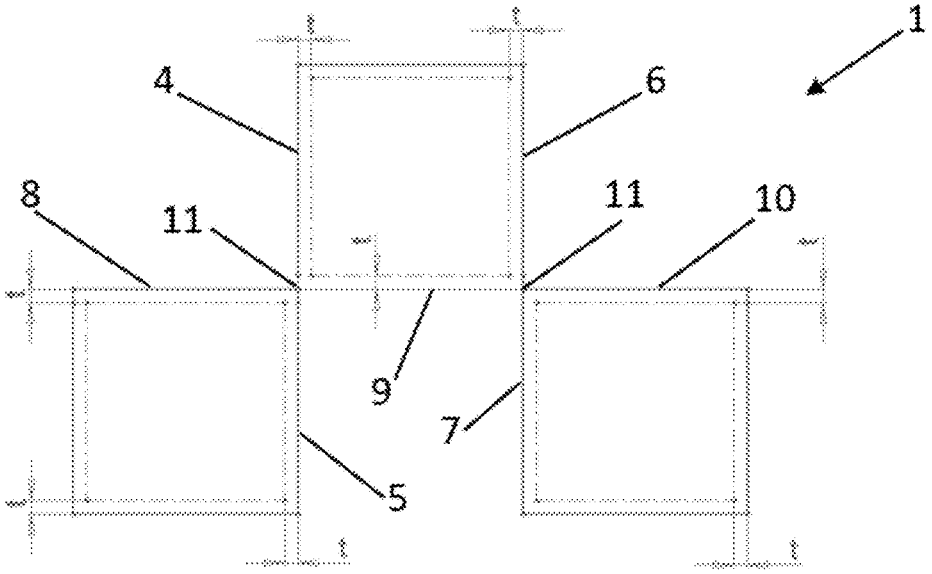
FIG. 4 illustrates a frontal view of Three Edge-Connected Cubes 1 sketched for the purpose of showing the thickness (or dimensions) of connection points 11.

FIG. 4 illustrates a frontal view of Three Edge-Connected Cubes 1 sketched for the purpose of showing that the thickness (or dimensions) of connection points 11 between the connected cubes is zero, and vertical edges 4 and 5 are collinear; and also, vertical edges 6 and 7 are collinear. As shown, horizontal edges 8, 9 and 10 are collinear also, for the purpose of declaring and conforming to the rules of having edge-connected cubes suitable for being used as clusterable playing pieces in expandable stair-like board games, subject of this invention.

Figure 5:
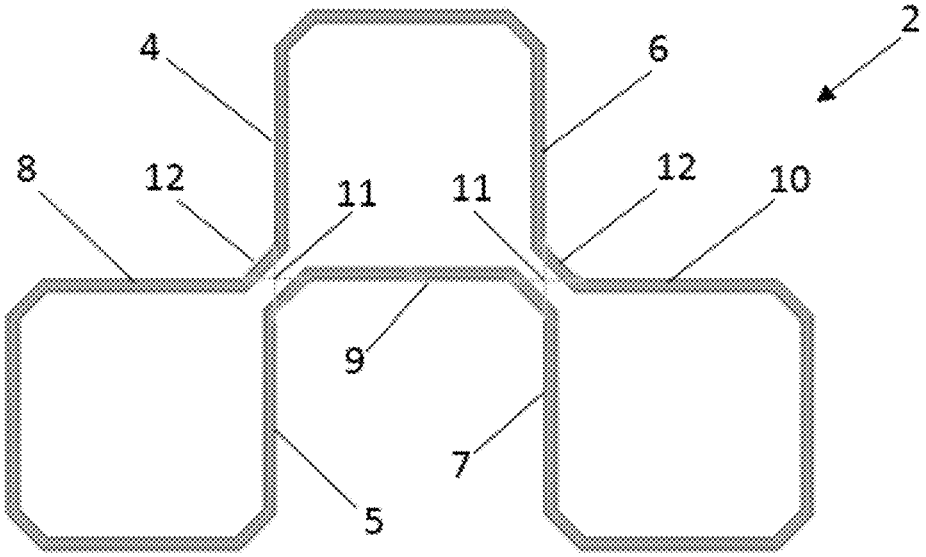
FIG. 5 illustrates a frontal planar view of a Trio-Cubes2.

FIG. 5 illustrates a frontal planar view of a Trio-Cubes 2 (with wall thickness equal to "t"), which is designed to maintain the collinearity of vertical edge 4 with vertical edge 5, and collinearity of vertical edges 6 and 7. As shown, horizontal edges 8, 9 and 10 are also collinear. Three semi-cubes (one in middle and two side cubes) are connected to each other by a 45 degree inclined connection formation 12, for example, designed to virtually maintain a point of connection (or zero-thickness connection) 11 between the cubes.

Figure 6:
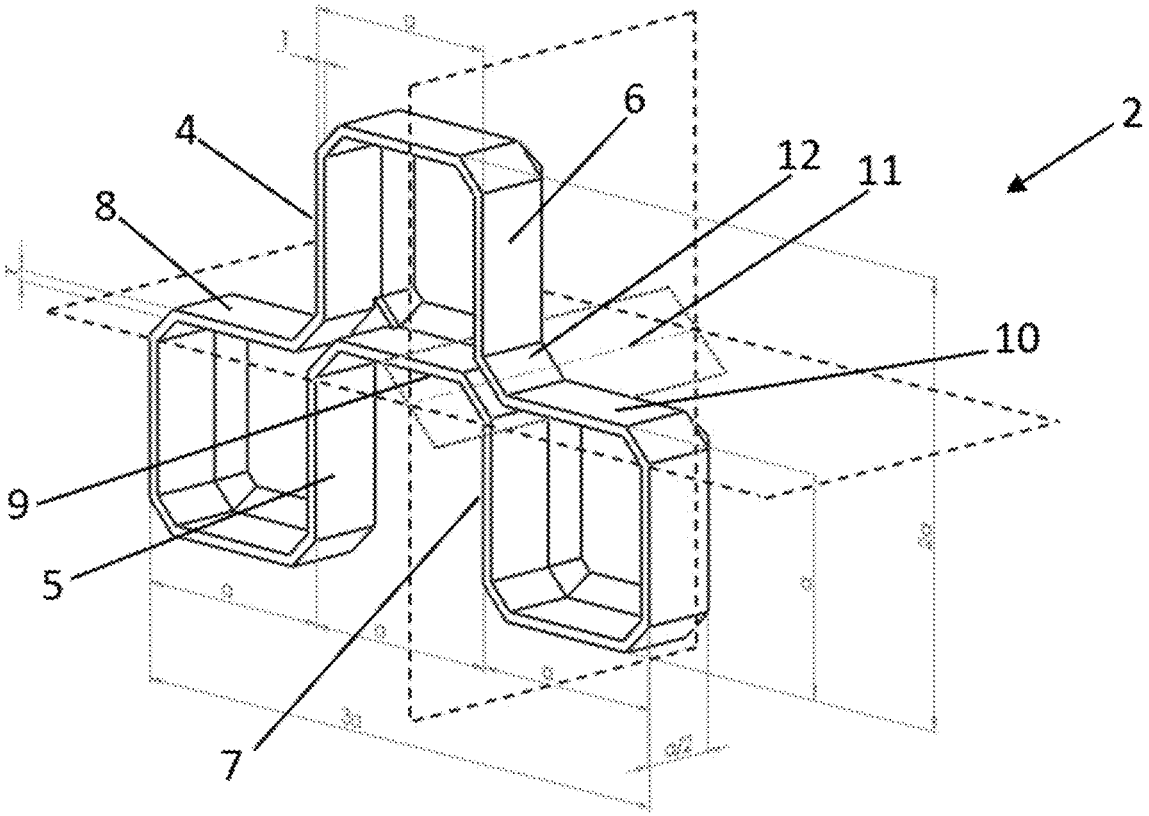
FIG. 6 shows a perspective view of a Trio-Cubes2.

FIG. 6 shows a perspective view of three edge-connected cubes 2. Each hollow semi- or half-cube (one in the middle and two side cubes) have a height equal to "a" and width equal to "a/2" and the wall thickness equal to "T", for example. Horizontal faces numbered 8, 9 and 10 are all in one horizontal plane; vertical faces 6 and 7 are in one plane and the same is maintained for vertical faces 4 and 5. Both side-cubes are connected to middle-cube by forty-five degree inclined connection formation faces 12 that are designed to virtually maintain zero-thickness connection rule between the cubes, depicted as virtual centerline 11.

Figure 7:
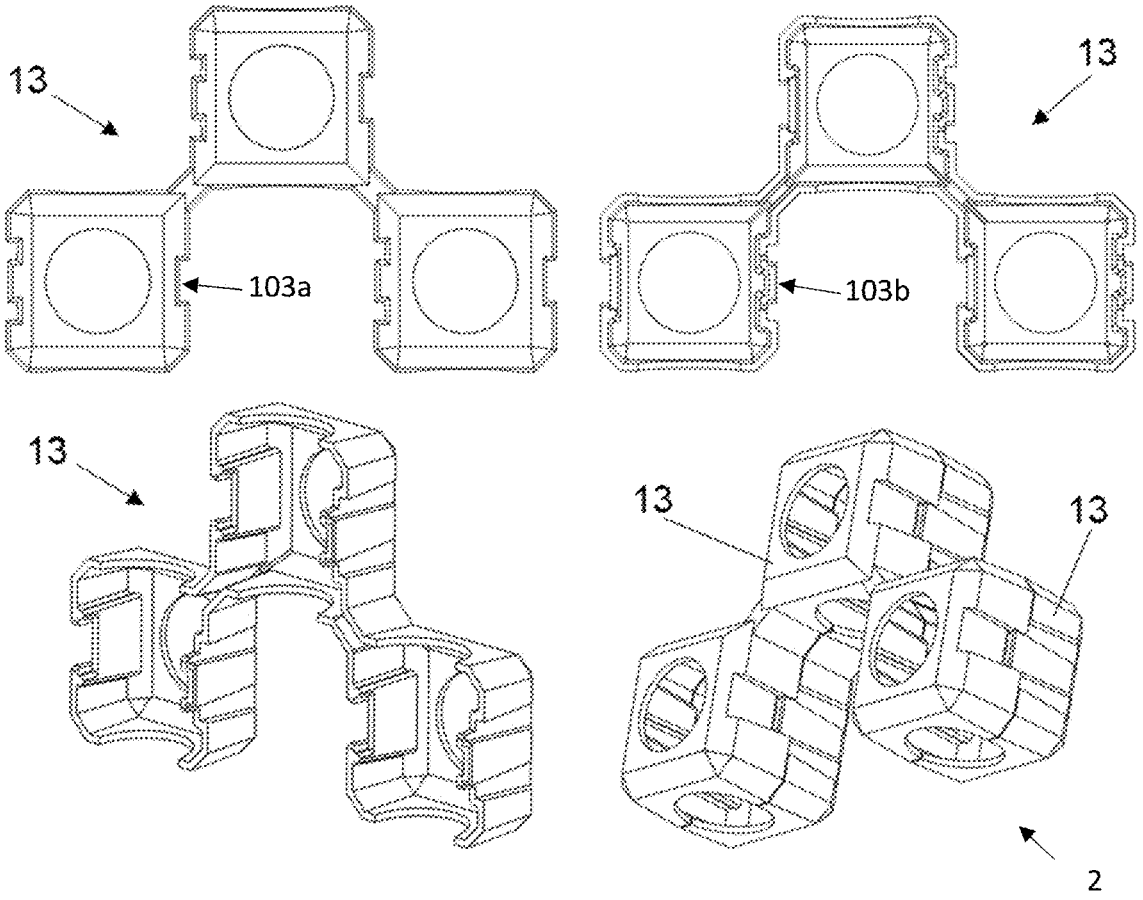
FIG. 7 illustrates a front planar view (top left) and back planar view (top right) and also back perspective view (bottom left) of sub-block 13 that is derived from Trio-Cubes2 (bottom right).

FIG. 7 illustrates front planar (top left) and back planar (top right) views and also front perspective (bottom right) and back perspective (bottom left) views of sub-block 13 that is derived from Trio-Cubes2 (having 3-degree drafted side-faces designed for injection molding purposes) with male and female connection formation means shaped by matching patterned recesses 103*a* and bosses 103*b* on side-faces of the half-cubes for connecting two sub-blocks 13 to each other and forming one "three edge-connected cubes" 2, as a manufacturable version of Trio-cubes2.

Figure 8:
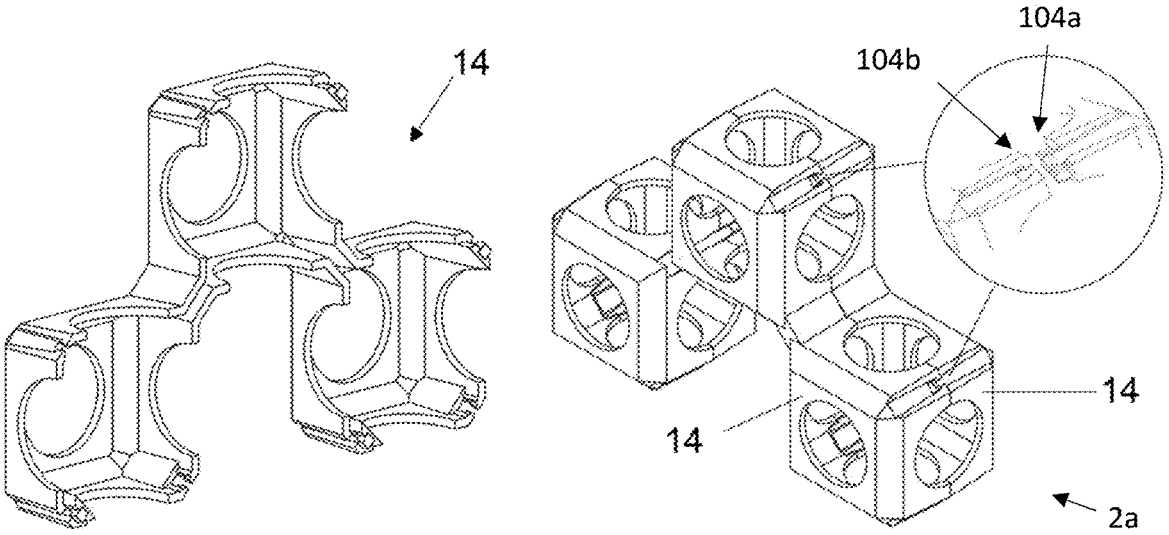
FIG. 8 shows a perspective view (left) of sub-block 14 with male and female connection formation means shaped on top of corner edges, and two connected sub-blocks 14 (right) connected via the male and female connection formation means (right inset).

FIG. 8 shows a perspective view of sub-block 14 with male 104*a* and female 104*b* connection formation means shaped on the top of corner edges, where two side-faces of the half-cube meet, for connecting two sub-blocks 14 to each other and forming one "three edge-connected cubes" 2*a*, as another version of Trio-cubes2.

Figure 9:
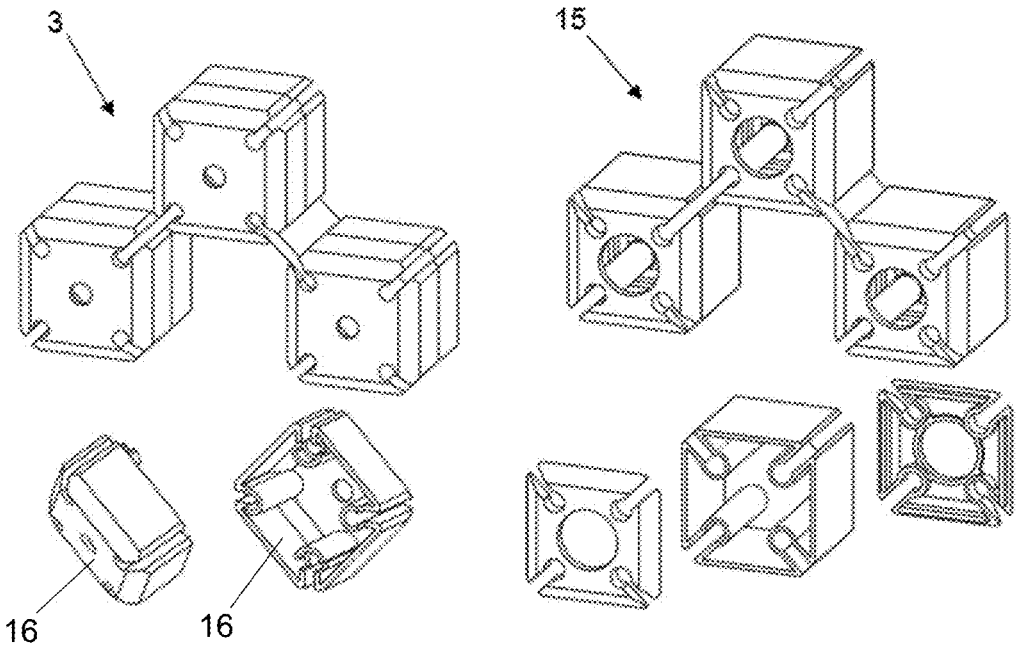
FIG. 9 shows perspective views of other versions of Three edge-connected cubes 3 and 15 which is another version of Trio-cubes3 and their sub-blocks 16.

FIG. 9 shows a perspective view of other versions of Three edge-connected cubes 3 and 15 which are other versions of Trio-cubes3. As assembled, Trio-cubes 3 and Trio-cubes 15 include several parts (or sub-blocks 16) that come together to form the main part. Sub-block 16 (from which the main parts of Trio-cubes 15 and 3 are also derived) is further explained in FIGS. 11-14.

Figure 10:
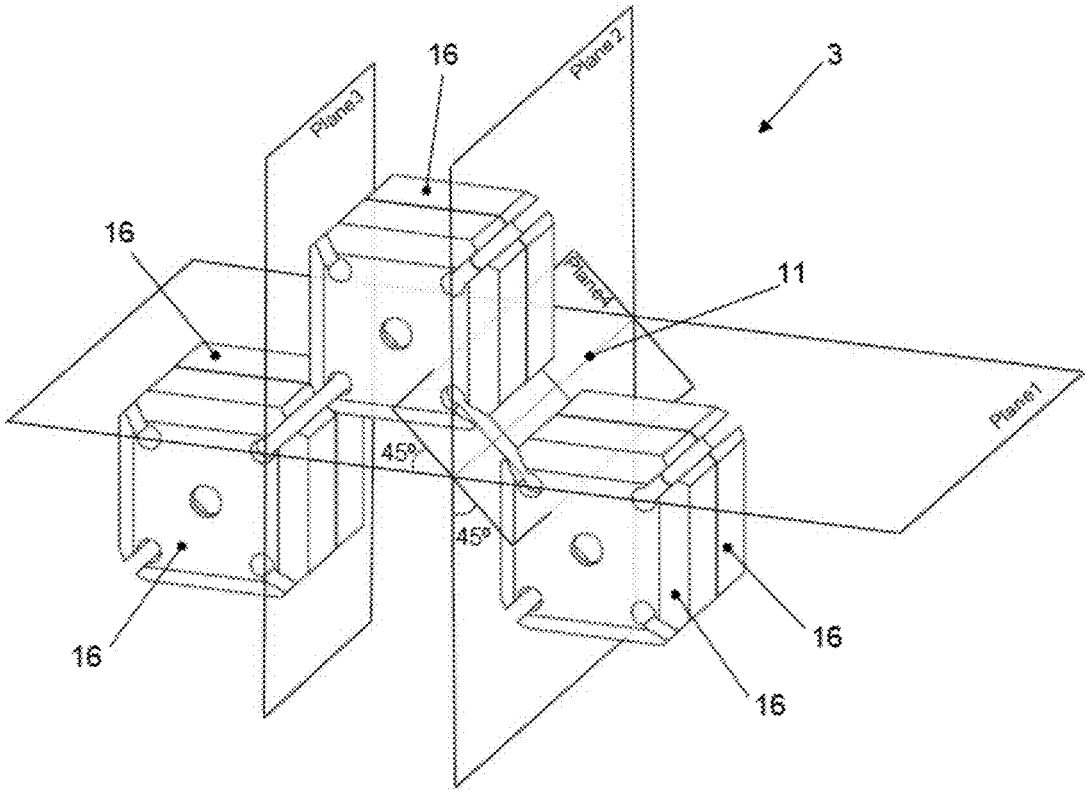
FIG. 10 is a perspective view of an assembled playing piece Trio-cubes3 3 configured of three edge-connected cubes, where each cube is assembled by using two half-cubes or sub-blocks 16 as the main type of sub-block.

FIGS. 7, 8 and 9 are intended to show the possibility of designing several versions of edge-connected cubes, and also to explain and emphasize that, regardless of the numbers of sub-blocks and various external shapes and connectors, a tangible (stair-like and clusterable) playing piece designed for playing expandable boards games may conform to basic clusterability rules, based on which the thickness of virtual edge-connection line between the cubes (e.g., the virtual center-line segment 11, where the edge of middle cube meet the side cube's edge), is zero (for example, as depicted at FIGS. 3, 6 and 10).

FIG. 10 is a perspective view of an assembled playing piece Trio-cubes 3 configured of three edge-connected cubes such that each cube is assembled by using two half-cubes or sub-blocks 16 as the main type of sub-block (the two of which are assembled in FIG. 10). Sub-blocks 16 are configured for forming a cube with multiple (female) connecting means (or possibilities) formed on the cube's edges. The connecting part (a 45 degree inclined sub-block designed for connecting the cubes) connects the cubes to each other and maintains the necessary virtual zero thickness edge-connection line 11 between the cubes, for the purpose of facilitating the assembly of clusterable playing means, in the shape of edge-connected cubes.

Figure 11:
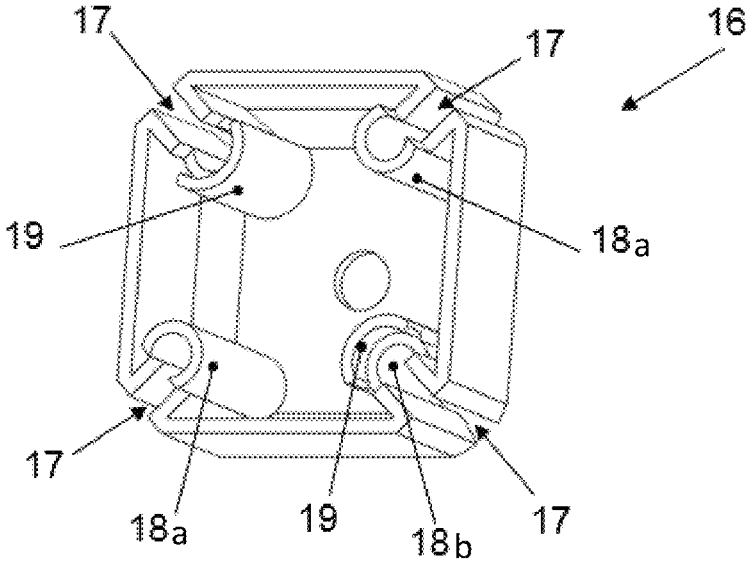
FIG. 11 is a perspective view of sub-block 16, designed as the main sub-block type for a building block system for the purpose of facilitating the formation or assembly of cubes with multi face- and edge-connectivity (female) means.

FIG. 11 is a rear perspective view of sub-block 16, designed as the main sub-block type for a building block system for the purpose of facilitating the formation or assembly of cubes with multi face and edge connectivity means (female). A half-cube or sub-block 16 may be equipped with connection formation means in shape of a hollow cylindrical boss 18. The hollow cylindrical boss 18 may be formed on one or four edges, for example, on side faces of a half-cube where the two side faces meet. A hollow cylindrical boss 18 is open on one side, toward the open corner-passage (or edge-passage) 17, where the two side faces meet. Two cylindrical bosses 18*a* on opposite sides may have longer heights than the height of the side-face walls of the half-cube 16, and two other opposite cylinders 18*b* may be designed with heights shorter than the height of the side-face walls. The outer walls of the shorter cylinders 18*b* may be merged with (i.e., tangential to) the inner-side of the walls of half-cylindrical bosses 19.

Figure 12:
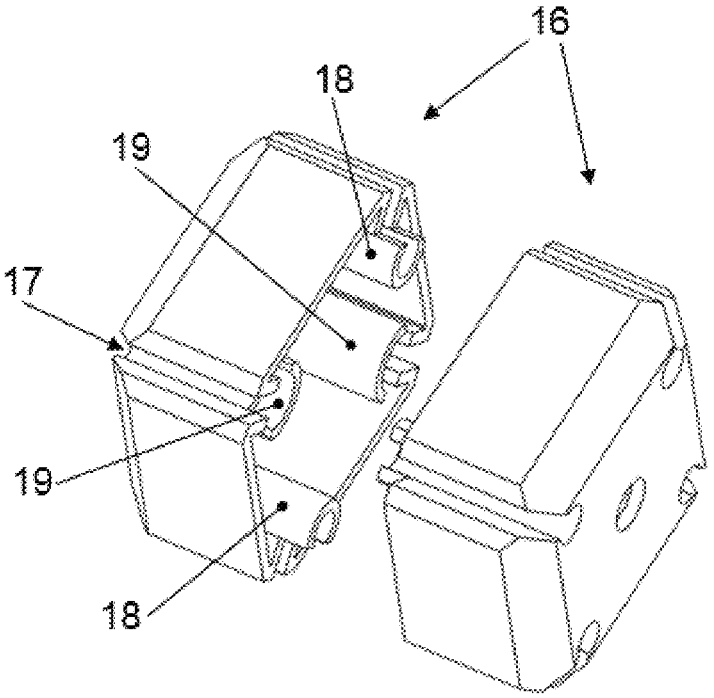
FIG. 12 is a perspective exploded view of two half-cubes or sub-blocks 16 that can be connected to each other.

FIG. 12 is a perspective exploded view of two half-cubes or sub-blocks 16 that can be connected to each other using (e.g., male-type) cylindrical bosses 18 and half-cylinder bosses 19 for forming a cube with hollow corner passages 17 formed on the edges of the assembled cube, where the two side-faces of assembled cube meet. Sub-blocks 16 are designed for the purpose of being assembled with each other forming a cube that can be assembled with other similarly assembled cubes, using several types of sub-blocks, and for presenting a building blocks system, in order to assemble and construct edge and face connected playing pieces of a number of cubes, as depicted on FIGS. 15-17 and 33-35.

Figure 13:
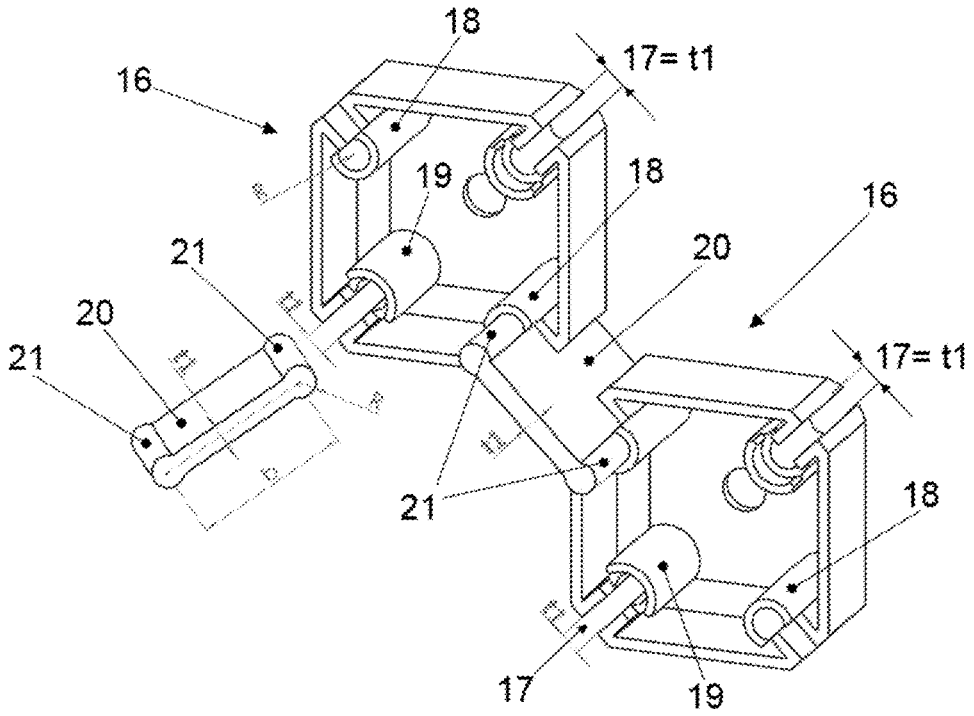
FIG. 13 is a perspective view of two sub-blocks 16 connected to each other by one sub-block 20.

FIG. 13 is a perspective view of two sub-blocks 16 connected to each other by one sub-block 20 designed as a type of edge-connector sub-block 20 that could be slid inside the desirably hollow edge-cylinders 18 (e.g., having female connection formation means for sub-block 16). Thickness of an edge-connector (sub-block 20) may be equal to "t1" which is equal to the width of open edge-passage 17. Sub-block 20 may be, in one embodiment, equipped with two cylindrical protrusions on opposite sides 21, for example. In certain embodiments, the radius of a cylinder "R" may be equal to the radios of the inner (cylindrical) wall of edge-cylinders 18, such that sub-block 20 may slide inside both edge-passage 17 and hollow edge-cylinder 18. The distance between the centers of each cylinder 21 may be equal to length "b".

Figure 14:
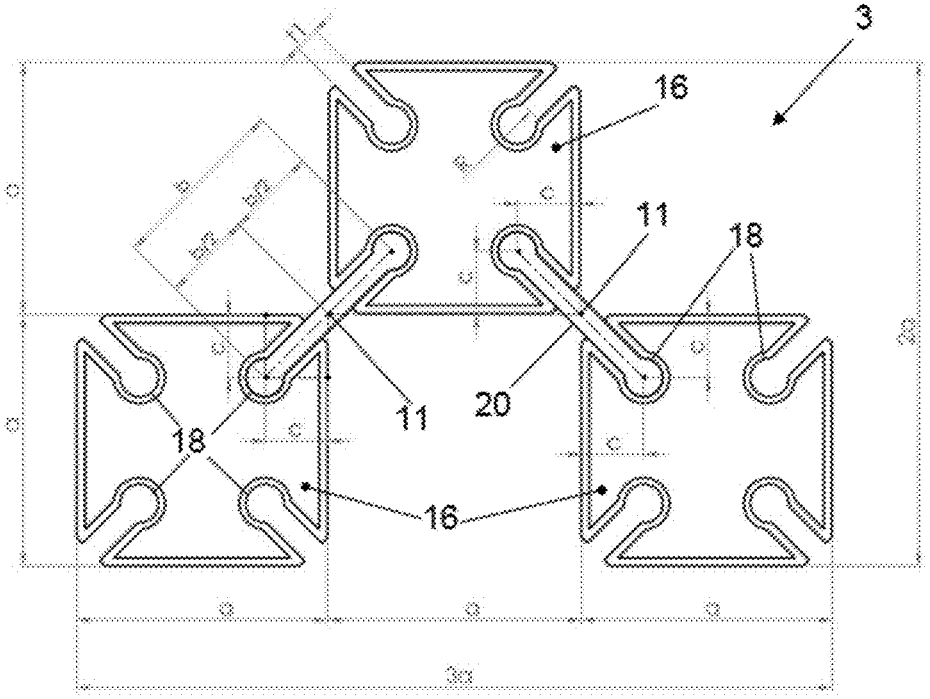
FIG. 14 is a front view of "Three Edge-Connected Cubes" or "Trio-cubes3 3".

FIG. 14 is a front view of "Three Edge-Connected Cubes" 3 or "Trio-cubes 3". The middle-cube is connected to two side-cubes by using two sub-blocks 20 (as the edge-connector parts or sub-block 20) such that the distance between the centers of each of its side-cylinders 21 is equal to "b". "b" is to be calculated such that that the midpoint (b/2) and the virtual centerline or point 11 can maintain the clusterability of cubes of playing pieces (in stair-like expandable board games). Accordingly, "b" the distance between the centers of each cylinder 21 of sub-block 20 as shown in FIGS. 13 and 14 may be calculated by $(b/2)^2=2c^2$, where "c" is the distance between the center of cylindrical bosses 18 (i.e., edge-connection formation means 18) and the nearest external wall of the (half-cube) sub-block 16.

Figure 15:
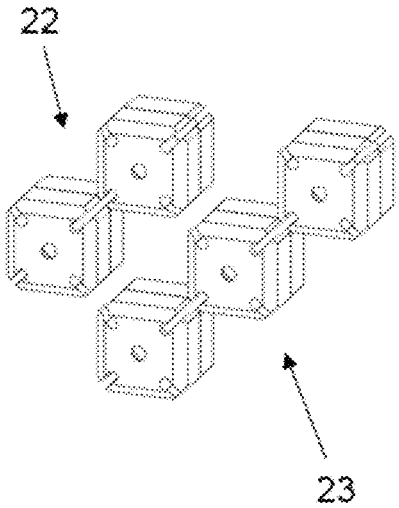
FIGS. 15, 16 and 17 show perspective views of multi edge-connected cubes having different numbers of cubes connected in various orientations.
Figure 16:
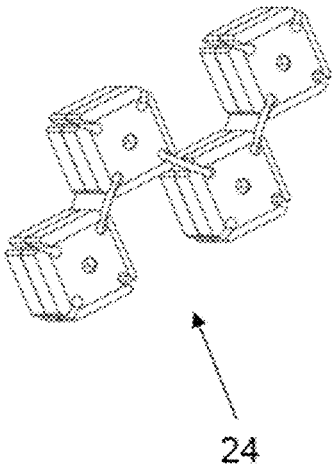
Figure 17:
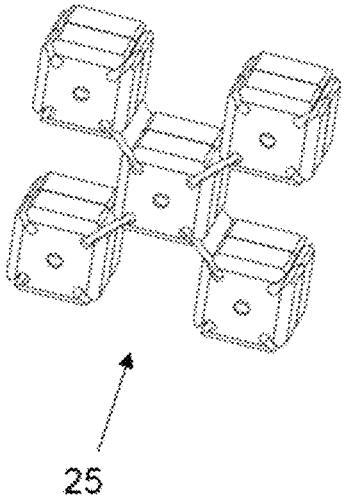

FIGS. 15, 16 and 17 show perspective views of multi edge-connected cubes numbered 22, 23, 24 and 25, with different numbers of cubes, ranging from two to five edge-connected cubes respectively, which can be used as playing pieces together with default playing pieces (Three edge-connected cubes) for playing stair-like expandable board games.

Figure 18:
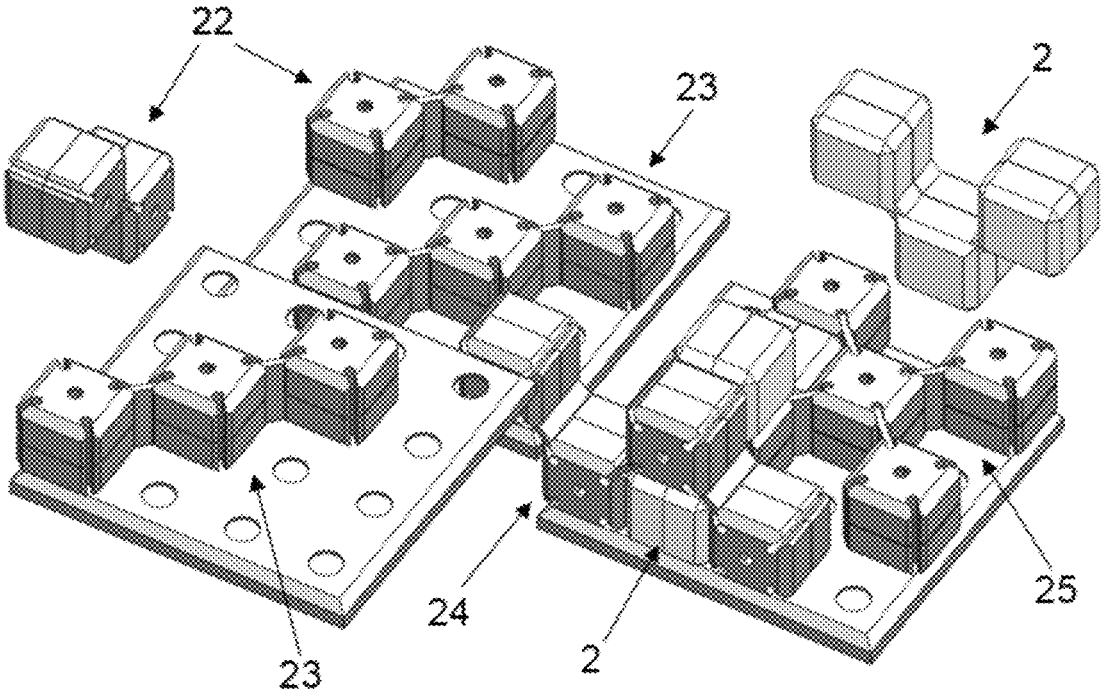
FIG. 18 is a perspective view of a stair-like expanded board game using a mix of clusterable (stair-like) playing pieces connected in various orientations.

FIG. 18 is a perspective view of stair-like expanded board games using a mix of clusterable (stair-like) playing pieces 2, 22, 23, 24 and 25.

Figure 19:
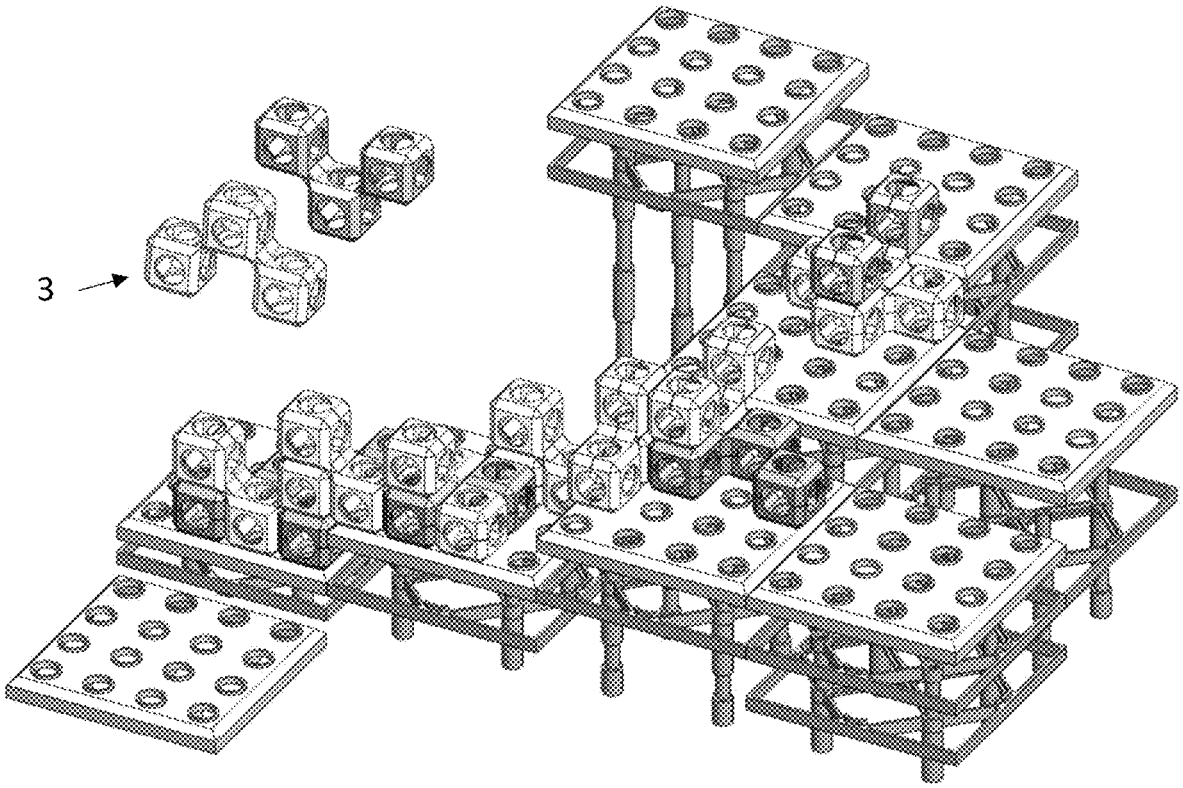
FIG. 19 is a perspective view of a stair-like expanded board game using default playing means.

FIG. 19 is a perspective view of stair-like expanded board games using default playing means (Trio-Cubes 3, for playing the Basic Game).

FIGS. 18 and 19 are also for the purpose of declaring that (regardless of the numbers of cubes of playing means), any versions of stair-like expandable board games are to be played based on two basic, primary and principal game rules manifested and depicted at FIGS. 20 to 25.

For the purpose of illustrating the Basic Game's playing method and primary game rules, (both depicted at FIGS. 20-29), Trio-Cubes 3 are chosen as default playing pieces, representing clusterable (stair-like) playing means (for playing the expandable boards game).

Figure 20:
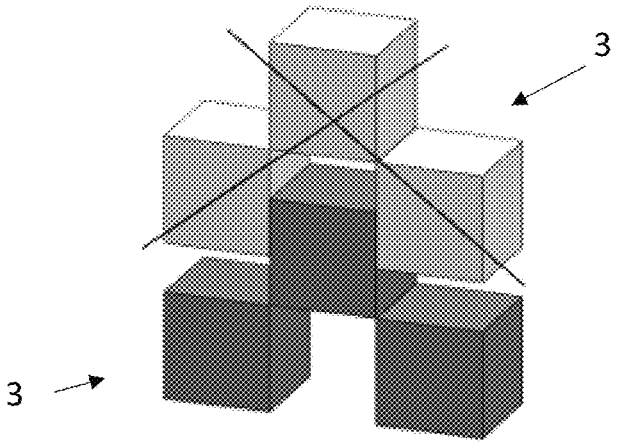
FIGS. 20, 21 and 22 show Basic Rule number One which specifies that one playing piece should not be placed on another playing piece of the same connection configuration, cube by cube.
Figure 21:
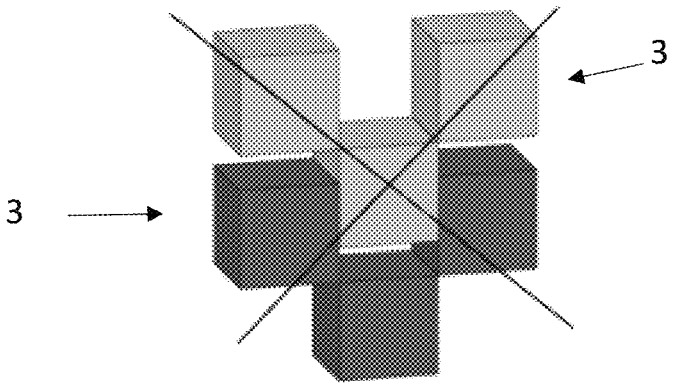
Figure 22:
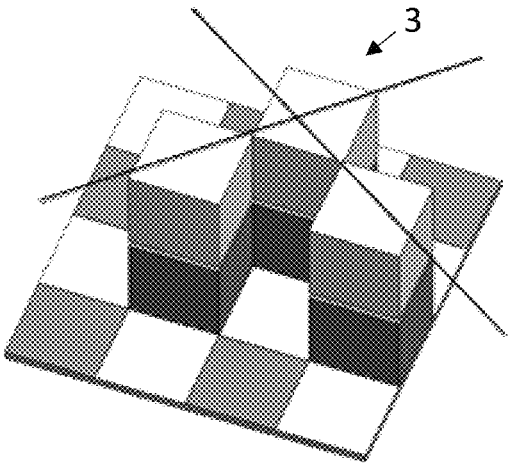

FIGS. 20, 21 and 22 show Basic Rule number One, based on which one playing piece should not be placed on another same playing piece, cube by cube. For example, if playing means are edge-connected "Trio-Cubes" 3, then one Trio-Cubes 3 is not be placed on another Trio-Cubes 3, cube by cube, at the same position. As depicted in FIGS. 20, 21 and 22, placing middle cube on middle cube and side cubes on side cubes is not allowed. In brief, based on mandatory Rule One: "One on One cube by cube same position (on same playing piece), is Not Allowed".

Figure 23:
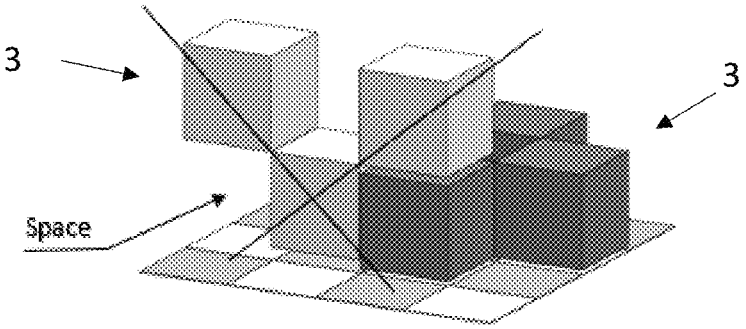
FIGS. 23, 24 and 25 show Basic Rule number Two which specifies that no space is allowed under a cube of playing pieces.
Figure 24:
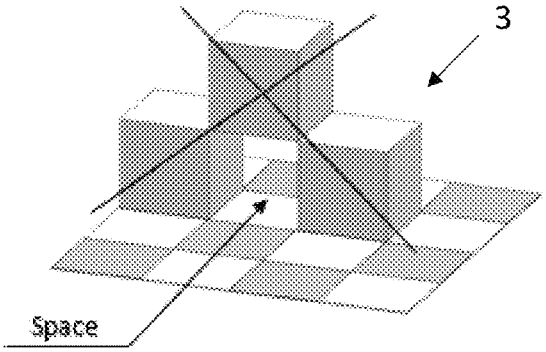
Figure 25:
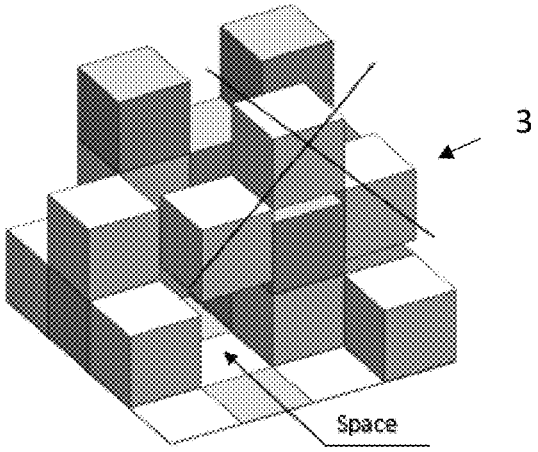

FIGS. 23, 24 and 25 show Basic Rule number Two based on which no space is allowed under a cube of any playing pieces. For example, if playing pieces are Trio-Cubes 3, then based on Rule number Two, three faces are to touch three faces whether they are square faces of the board or of already played/placed playing pieces, as depicted at FIGS. 26 and 27, and no empty space is allowed under a cube of the playing pieces.

Figure 26:
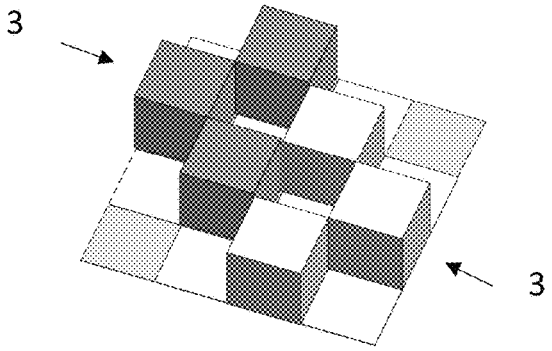
FIGS. 26 and 27 show the right moves or correct playing (or placing) of played playing pieces.
Figure 27:
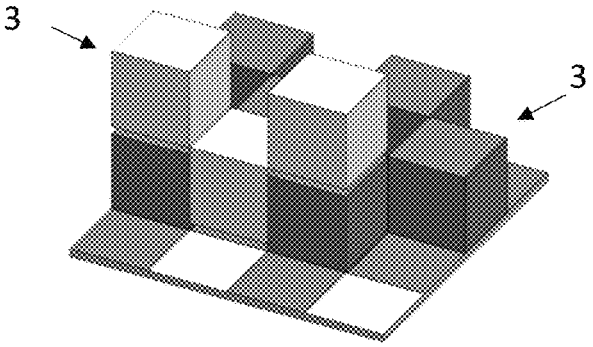

FIGS. 26 and 27 show the right moves or correct playing (or placing) of played playing pieces. According to game rules numbers one and two, the square faces of white and black Trio-cubes 3 each are touching the board's squares (as depicted at FIG. 26), and those of white "Trio-Cubes" 3 (as depicted on FIG. 27) are touching one square on the board and square faces of two cubes of other playing pieces (black Trio-Cubes 3), showing a correct move.

Figure 28:
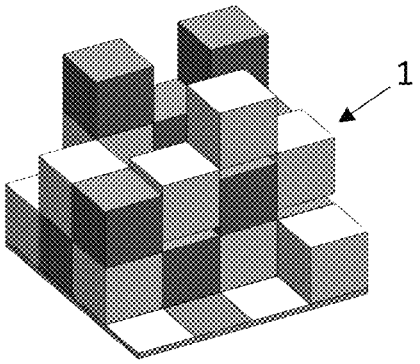
FIG. 28 shows the correct move and also game finishing (or winning) final move for the white playing piece (Trio-Cubes1 1).

FIG. 28 also shows the correct move and also game finishing (or winning) final move for the white playing piece (Trio-Cubes 1). According to game rules number one and two, the white playing piece (Trio-Cubes 1) is being correctly placed and it is also the last played playing piece (of that board) for winning the game set, because after that, no other playing piece can be played (or placed on board's playing area) that could also comply with the principal primary rules numbers one and two. Therefore, the object of the game is achieved and the game (for that board) is finished. Without the basic rules numbers one and two, there will be no ending for any board game set.

Accordingly, rules number one and two are both mandatory rules that together make platform laws for creating any versions of stair-like expandable board games (using clusterable stair-like face- and/or edge-connected cubes as playing pieces). Obviously, numerous versions of stair-like expandable strategy board games can be created utilizing various stair-like clusterable playing pieces (FIGS. 15-17 and also FIGS. 31 and 34), but in order to avoid loops in game sets, as far as possible, any versions (of the presented game, subject of this disclosure) are to be created based on these two basic platform laws. Accordingly, any other rules will be considered as secondary game laws or optional rules.

Figure 29:
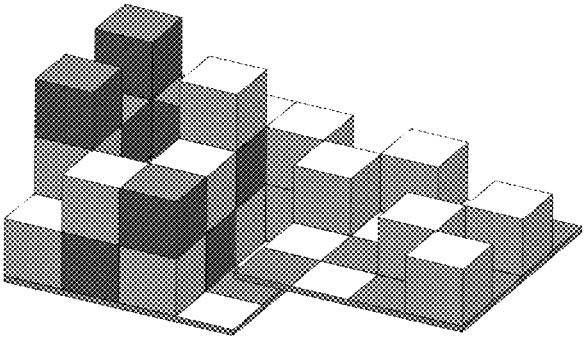
FIG. 29 shows a secondary rule, wherein another board can be attached to an already finished game.

FIG. 29 shows a secondary rule, wherein another board can be attached to an already finished game (the winner of which has been determined) the new board could be attached at a board level or one cube height level up (shaping stair-like boards). The playing area of the new attached board can now be extended to all available square spaces of the previous board and (optionally) to square faces of played (or placed) playing pieces (of previously finished boards), and players can use these new extended board areas for placing their playing means, based on the basic (mandatory) game rules one and two.

Figure 30:
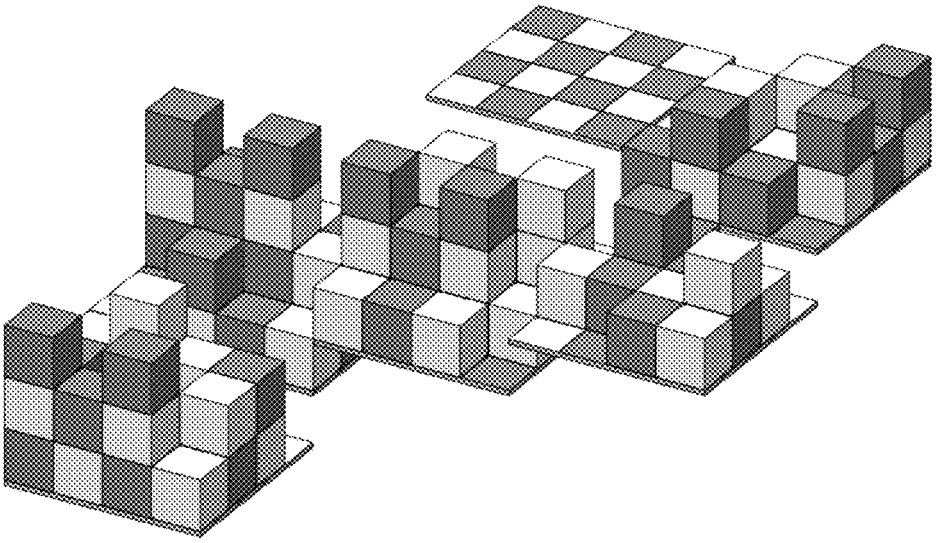
FIG. 30 shows a perspective view of a digital game having six stair-like shaped boards, five of which are fully played and finished, wherein the winner of each board is determined by placing the last playing piece on the last available position open for play.

FIG. 30 shows a perspective view of digital game of six stair-like shaped boards, five of which are fully played and finished, wherein the winner of each board is determined by placing the last playing piece on the last available place allowed.

Figure 31:
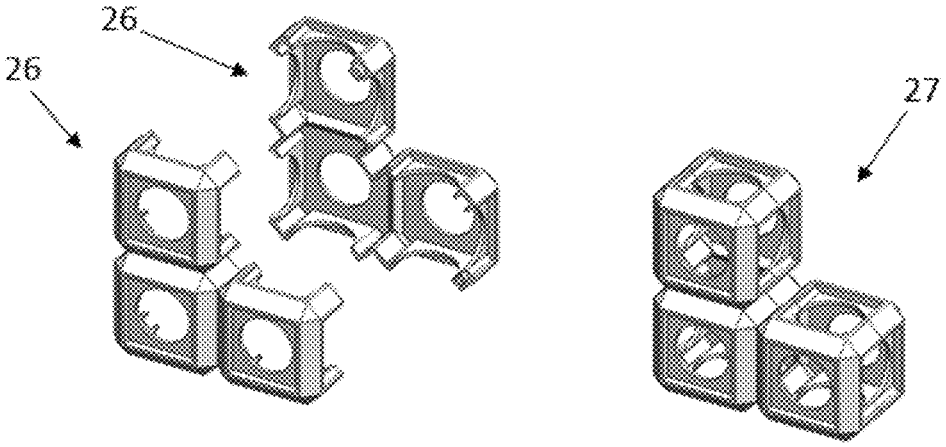
FIG. 31 shows a perspective view of two sub-blocks 26 and 27.

FIG. 31 shows a perspective view of two sub-blocks 26 that can be assembled for forming the playing piece 27 in shape of Three (stair-like) Face-Connected Cubes (L-shaped cubes 27), having one cube in the middle and two face-connected side-cubes. The middle cube share faces with the connected side-cubes, and the two side-cubes are to conform to clusterability designing instructions for edge-connected cubes (as depicted in FIGS. 3-6).

Figure 32:
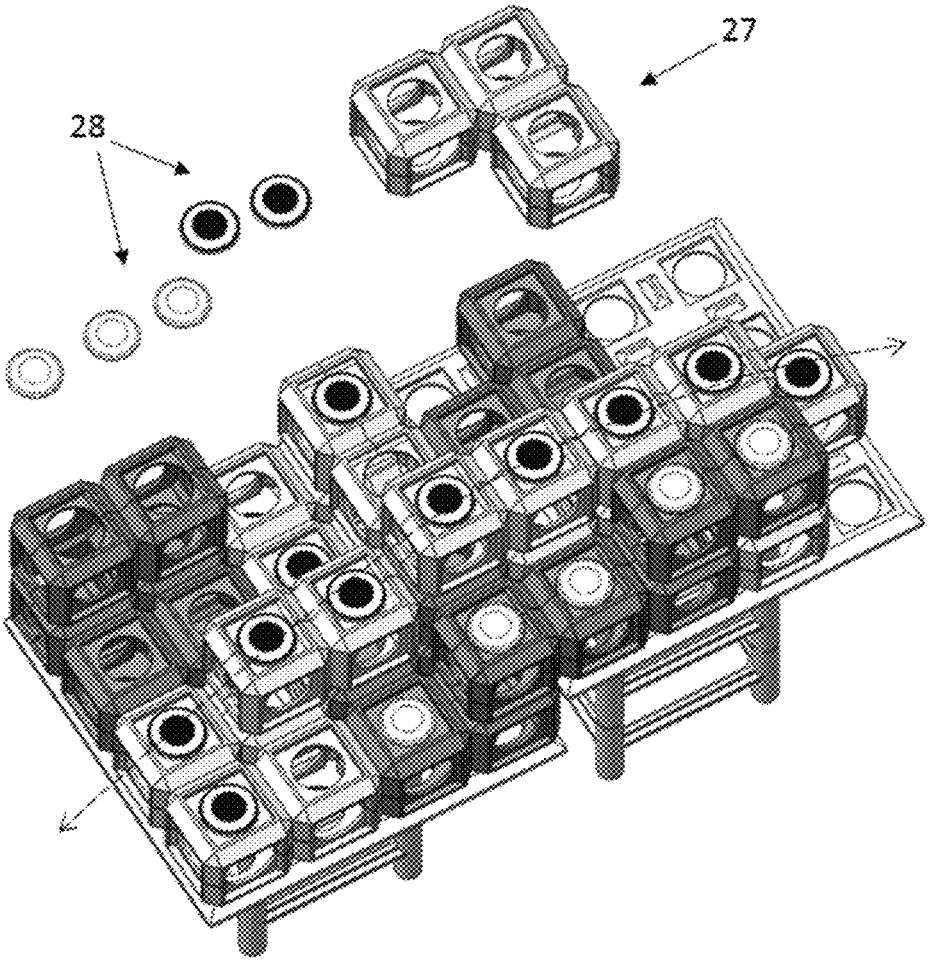
FIG. 32 shows a perspective view of another version of a stair-like games using face-connected cubes.

FIG. 32 shows a perspective view of another version of the stair-like games using face-connected cubes (L-shaped cubes 27), as its main (stair-like and clusterable) playing means, and disc-like playing pieces (28) as secondary playing pieces for scorings and/or creating a different goal (or mix of goals). For example, based on this version of stair-like expandable board games, a goal of the game is to connect two opposite sides of the boards. Also, other point rules can be set for the game as to how a game may advance and how a player may earn additional points. Since this game is mainly a version of expandable stair-like boards games, therefore, basic and primary game rules numbers one and two (as depicted at FIGS. 20-25) may govern the basic game play for playing/placing the playing means on playing area (that include both the boards' squares and the allowed square faces of played/placed playing means.

Secondary and tertiary playing rules and playing means can be applied to expandable stair-like board games for making new game versions with mix of goals and/or mix of playing pieces (such as numbered or colored disc-like pieces 28), as shown on FIG. 32.

Figure 33:
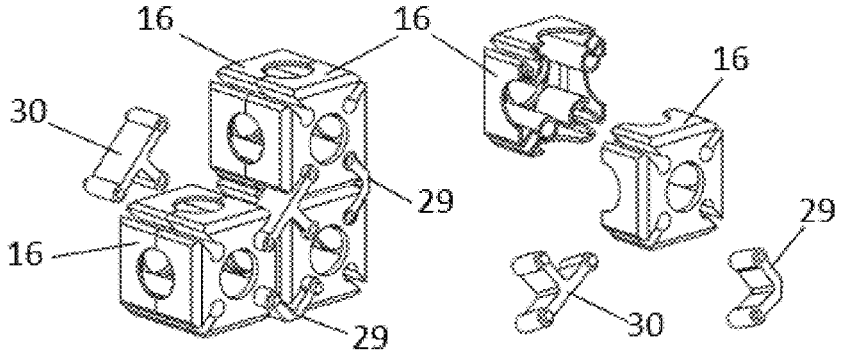
FIG. 33 shows a perspective view of one stair-like face-connected cube formed from sub-blocks 16 and connected by cube-connectors 29 and 30.

FIG. 33 shows a perspective view of one stair-like face-connected cubes (or "L-shaped cubes") that is configured by an assembly of six half-cubes (sub-block 16), and connected to each other using sub-blocks 29 and 30 (as sub-block connectors) that can be used for assembling more cubes and forming different face- or edge-connected playing pieces at any numbers of cubes (that are clusterable too.)

Figure 34:
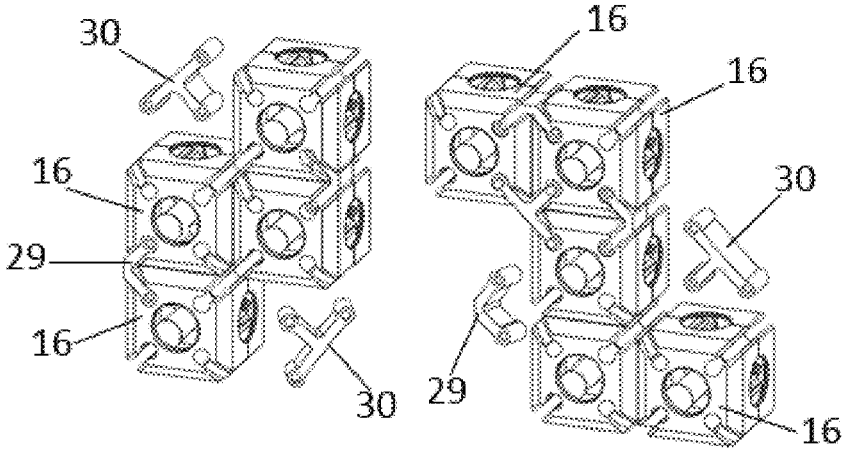
FIG. 34 shows a perspective view of two stair-like face-connected cubes assembled from half-cubes 16 and cube-connectors 29 and 30.

FIG. 34 shows a perspective view of two stair-like face-connected cubes assembled by half-cubes (sub-block 16) and cube-connectors (sub-blocks 29 and 30). Playing pieces of (stair-like) face-connected cubes can be formed and used in various shapes or in mix with other face- and/or edge-connected playing pieces for configuring and assembling other versions of clusterable playing pieces for creating various expandable stair-like board games.

Figure 35:
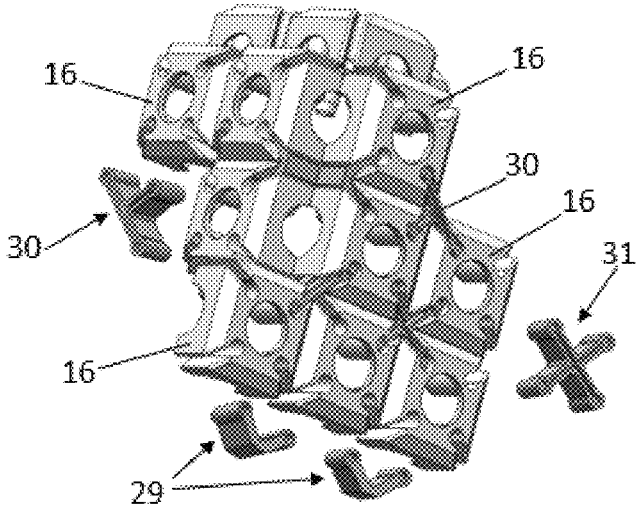
FIG. 35 shows a perspective view of assembling and constructing possibilities of half-cubes 16 as the main block of a new building blocks system.

FIG. 35 shows a perspective view of assembling and constructing possibilities of half-cubes (sub-block 16) as the main block of a new building blocks system, with multi edge and face connectivity capabilities. Sub-block 16 is the main type of block (of invented building block system) that together with other adjacently arranged sub-blocks and related connector means (like sub-blocks 29, 30 and 31 or other designed sub-block connectors) can be used for assembling of bigger sizes of stair-like (and clusterable) playing pieces and many other assemblies and structures, and therefore it can be considered as a "Building Block System" for entertainment purposes.

Figure 36:
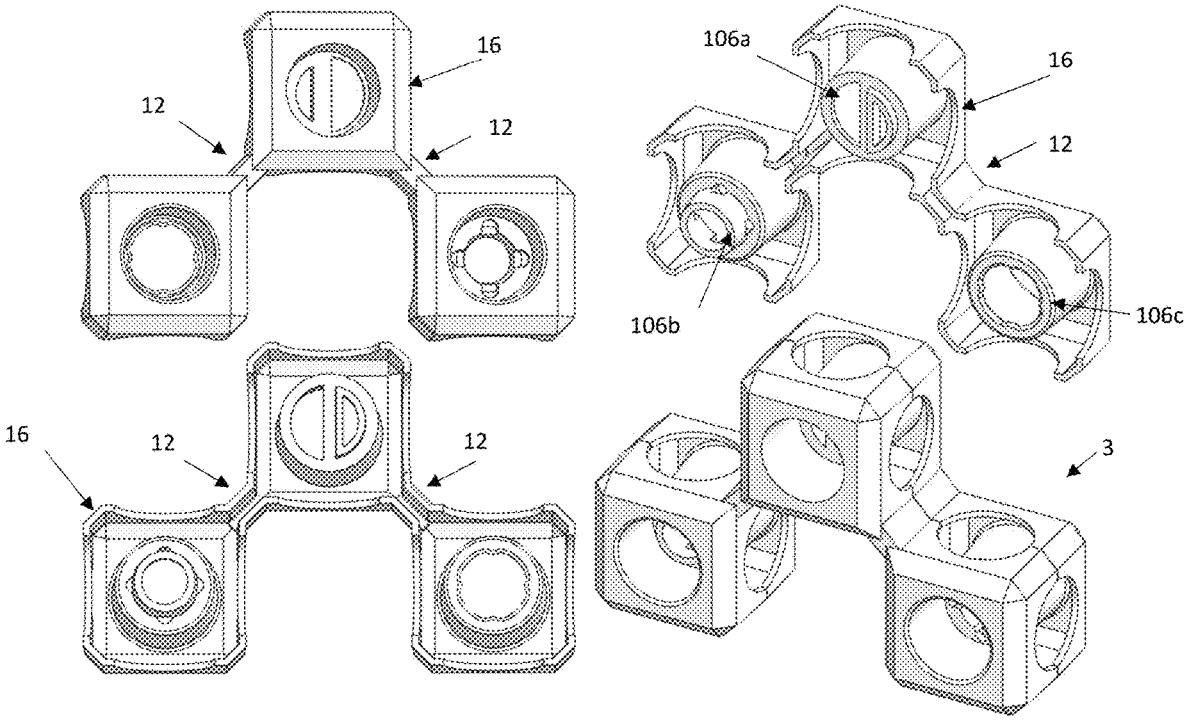
FIG. 36 shows frontal planar (top left), back planar (bottom left), and back perspective (top right) views of sub-blocks 17 which can be connected to form Trio-Cubes3 3.

FIG. 36 shows front and rear planar views (left top and left bottom respectively) and rear perspective view (right top) of half-cubes (sub block 16). Sub block 16 can be assembled into Trio Cubes 3. As described above, sub bock 16 is a main block type that can be used for assembling larger sizes of stair-like and clusterable playing pieces such as Trio Cubes 3. Sub block 16 can have a variety of shapes of connector means 106*a*, 106*b*, and 106*c* that fit into female connector means to form Trio Cubes 3. Sub block 16 includes three semi-cubes (one in middle and two side cubes) that are connected to each other by a 45 degree inclined connection formation 12.

The claimed subject matter has been provided here with reference to one or more features or embodiments. Those skilled in the art will recognize and appreciate that, despite the detailed nature of the exemplary embodiments provided here, changes and modifications may be applied to said embodiments without limiting or departing from the generally intended scope. These and various other adaptations and combinations of the embodiments provided here are within the scope of the disclosed subject matter as defined by the claims and their full set of equivalents.

A portion of the disclosure of this patent document may contain material subject to copyright protection. Certain marks referenced herein may be common law or registered trademarks of the applicant, the assignee or third parties affiliated or unaffiliated with the applicant or the assignee. Use of these marks is for providing and enabling disclosure by way of example and shall not be construed to exclusively limit the scope of the disclosed subject matter to material associated with such marks.

The invention claimed is:

1. A method of playing a board game, the method comprising:

a first basic rule, a second basic rule, and a game goal for a winning player to be selected from among a plurality of players playing the board game as a player that first moves a game piece on a game board in a last available configuration that complies with the first basic rule and the second basic rule, wherein no other game piece can be placed on the game board in a configuration that complies with the first basic rule and the second basic rule, a game piece for playing the game comprising at least two partially or fully cube-shaped pieces connected at connection point located on collinear corner edges of the at least two partially or fully cube-shaped pieces, wherein the connection point comprises a separate, removable piece that can be releasably inserted into receptacles located on collinear corner edges of each of the at least two partially or fully cube-shaped pieces.

2. The method of claim 1, wherein the first basic rule requires that a first game piece may not be placed adjacent to a second similarly shaped game piece in a same position as the second game piece, such that each portion of the first game piece is substantially on top of each corresponding portion of the second similarly shaped game piece.

3. The method of claim 2, wherein the second basic rule requires that no empty game space exist between the game board and a game piece placed on the board game as a part of a move made by a player participating in the game.

4. The method of claim 1, further comprising a plurality of game boards that may be connected in a stair-like configuration, wherein a connection between at least two of the plurality of game boards comprises a game piece having a first portion on a first game board and a second portion on a second portion of a second game board.

5. The method of claim 4, wherein the first basic rule and the second basic rule are implemented such that the game is not played endlessly on the first game board, and wherein the second game board is connectable to the first game board using a game piece played on the first game board in accordance with the first basic rule and the second basic rule.

6. A method of playing a game, the method comprising:

a first basic rule, a second basic rule, and a game goal requiring that the winning player is the player that places a game piece on a game board in the last available configuration that complies with the first basic rule and the second basic rule, such that no other game piece can be placed on the game board in a configuration that complies with the first basic rule and the second basic rule, the first basic rule requiring that a first game piece may not be placed adjacent to a second similarly shaped game piece in the same position as the second game piece such that each portion of the first game piece is substantially on top of each corresponding portion of the second similarly shaped game piece, and the second basic rule requiring that no empty space may exist between the game board and the game piece, a game piece for playing the game comprising at least two partially or fully cube-shaped pieces connected at connection point located on collinear corner edges of each of the at least two partially or fully cube-shaped pieces, wherein the connection point comprises a separate, removable piece that can be releasably inserted into receptacles located on collinear corner edges of each of the at least two partially or fully cube-shaped pieces.

7. The method of claim 6, wherein a first of the at least two partially or fully cube-shaped pieces comprise a first hollow sub-block and a second hollow sub-block configured to connect to each other to form the first of the at least two partially or fully cube-shaped pieces.

8. The method of claim 7, wherein the first hollow sub-block comprises at least one male connection feature and the second hollow sub-block comprises at least one female connection feature, such that the at least one male connection feature can be inserted into the at least one female connection feature to form the at least two partially or fully cube-shaped pieces.

9. The method of claim 8, wherein a first corner edge of a first partially or fully cube-shaped piece is connected to a second corner edge of a second partially or fully cube-shaped piece such that at least one side wall of the first partially or fully cube-shaped piece forms an approximately 90 degree angle with at least one side wall of the second partially or fully cube-shaped piece.

* * * * *